US006886863B1

(12) United States Patent
Mowry, Jr. et al.

(10) Patent No.: US 6,886,863 B1
(45) Date of Patent: May 3, 2005

(54) SECURE DOCUMENT WITH SELF-AUTHENTICATING, ENCRYPTABLE FONT

(75) Inventors: William H. Mowry, Jr., Dayton, OH (US); Martin H. Hileman, Beavercreek, OH (US); Robert T. Haller, Xenia, OH (US)

(73) Assignee: The Standard Register Company, Dayton, OH (US)

( * ) Notice: Subject to any disclaimer, the term of this patent is extended or adjusted under 35 U.S.C. 154(b) by 19 days.

(21) Appl. No.: 10/324,525

(22) Filed: Dec. 19, 2002

(51) Int. Cl.[7] ..... B42D 15/10
(52) U.S. Cl. ..... 283/72; 283/58; 235/494
(58) Field of Search ..... 283/57, 58, 72, 283/59; 235/379, 487, 494; 428/916

(56) References Cited

U.S. PATENT DOCUMENTS

| | | | | | |
|---|---|---|---|---|---|
| 1,564,724 | A | | 12/1925 | Todd et al. | |
| 4,641,346 | A | | 2/1987 | Clark et al. | |
| 4,681,348 | A | * | 7/1987 | Mowry, Jr. | 283/58 |
| 4,733,887 | A | * | 3/1988 | Mowry, Jr. | 283/58 |
| 4,749,213 | A | * | 6/1988 | Mowry, Jr. | 283/58 |
| 5,018,767 | A | | 5/1991 | Wicker | |
| 5,062,666 | A | * | 11/1991 | Mowry et al. | 283/67 |
| 5,168,147 | A | | 12/1992 | Bloomberg | |
| 5,291,243 | A | | 3/1994 | Heckman et al. | |
| 5,436,974 | A | | 7/1995 | Kovanen | |
| 5,509,692 | A | | 4/1996 | Oz | |
| 5,627,909 | A | * | 5/1997 | Blaylock et al. | 382/139 |
| 5,641,183 | A | * | 6/1997 | Diamond | 283/58 |
| 5,704,651 | A | * | 1/1998 | Phillips | 283/93 |
| 5,708,717 | A | | 1/1998 | Alasia | |
| 5,720,012 | A | | 2/1998 | McVeigh et al. | |
| 5,785,353 | A | | 7/1998 | Diamond | |
| 5,917,996 | A | | 6/1999 | Thorpe | |
| 6,045,881 | A | | 4/2000 | Gasper et al. | |
| 6,126,203 | A | * | 10/2000 | Dwork et al. | 283/58 |
| 6,341,730 | B1 | * | 1/2002 | Petrie | 235/494 |
| 6,530,601 | B2 | * | 3/2003 | Greene | 283/57 |

* cited by examiner

*Primary Examiner*—John A. Ricci
(74) *Attorney, Agent, or Firm*—Dinsmore & Shohl LLP

(57) ABSTRACT

A self-authenticating encryptable font for creating secure documents. The document onto which the font is printed includes a surface containing one or more transaction fields such that transactional data from the font is printed within at least one of these fields. The font includes human-readable characters that are defined by a fill pattern made up of spaced marks and a patterned background. Security characters, made up of one or more encryptable data elements, may also be included. The encryptable data elements may be either fixed or randomly variable with regard to each human-readable character, independent of the human-readable characters, or capable of alteration by an encryption algorithm. The presence of the unique human-readable characters and the encryptable data elements give the impression that the document on which they are printed may be subject to security enhancements, while alterations to the encryptable data elements by an algorithm can be used during the printing process to incorporate additional security information into the document. A user wishing to self-authenticate encrypted information incorporated into the encryptable data elements merely passes the document through an appropriately-configured scanning device, then compares the decrypted information with overt indicia on the document.

42 Claims, 7 Drawing Sheets

SECURE DOCUMENT WITH SELF-AUTHENTICATING, ENCRYPTABLE FONT

BACKGROUND OF THE INVENTION

The present invention relates generally to the printing of documents, such as negotiable instruments, that include security features, and more particularly to fonts for documents having one or more regions upon which secure transactional text is printed, such text comprising both human-readable attributes and machine-readable attributes to deter unauthorized duplication or alteration of the documents, as well as to self-authenticate transactional content within the font.

The use of security features for sensitive documents, such as checks or related negotiable documents, has been known in the art for some time. Typically, these sensitive documents will include a preprinted, patterned background and one or more transactional data fields onto which human-readable text is subsequently added by known means, such as computer-based printing. One conventional feature used to thwart unauthorized duplication or reproduction involves the use of latent pantographic images that reveal themselves upon processing the document through a copier, scanner or related device. Such pantographic images are designs that take advantage of the inherent limitations in the resolution thresholds of copying and scanning devices. Security image elements (such as lines or dots) exceeding such resolution threshold are interspersed into a document background made up of smaller security image elements such that the image formed by the larger security image elements is not readily apparent on the original, but manifests itself on the face of the reproduced document, making it apparent to even a casual observer that the document is not an original. Typically, these indicia will be in the form of a recognizable stock warning, such as "VOID" or "COPY".

Variations on this approach include the use of shaded and multi-colored surfaces, repeating pattern backgrounds, document-embedded objects and watermarks. For example, a blended or rainbow color scheme with graduated colors over the surface of the document, by virtue of subtle shading differences, is not easily copied. Similarly, the placement of an embedded object, such as a strip, or a watermark, neither of which shows up on a reproduced document, can be verified quickly by visual inspection. Additional warnings on the face of the document may be used to alert the document recipient to the presence of the strip or mark, and to suggest that its existence be checked for document authentication. Advancements, however, in technically sophisticated reproduction equipment have led to lower resolution thresholds, allowing various settings to be tried until the reproduced document is virtually indistinguishable from the original. Moreover, the incorporation of pantographic images, blended color schemes, watermarks and similar passive background approaches, even if protective of the authenticity of the document, provides no assistance in ascertaining the genuineness of the transactional data printed on such document.

One way to provide transactional data protection is to encode and print machine-readable information onto the surface of the original document, an example of which can be found in U.S. Pat. No. 5,951,055, assigned to the assignee of the present invention. This can be accomplished through the use of an algorithm-driven encoding scheme in conjunction with computer-based printing devices. In such an approach, the algorithm instructs the printer to add visually unobtrusive markings (often called glyphs) into one or more areas of the document. In the present context, a glyph is a mark in the form of a geometric pattern made up from a plurality of individual pixels. Typically, in the case of an elongate mark (such as a line), the glyph is one pixel wide. Based on instructions from an encryption algorithm, these glyph patterns are rearranged in one or more of the gray-scale portions of a printed medium such that a scanning machine equipped with a suitable decryption routine can verify the authenticity of the information contained in the document's human readable characters. For applications where most printing is accomplished with black ink using a high-resolution (i.e., 300 dpi, 600 dpi or higher) print device, these markings can amount to a rearrangement of the dot patterns in the gray scale shadings in such a way that encoded information is juxtaposed with unencoded text dots. The human eye detects what appears to be conventional, unencoded information, while the encoded information is detectable by a machine reader, such as an optical recognition system. Attempts at unauthorized reproduction are hampered by the inability of the copying equipment to faithfully reproduce the glyph patterns.

This encoding approach has the advantage over conventional bar code encryption in that the integration of security information is provided seamlessly, thus adding to the document's aesthetic appeal, as well as providing the option of having no readily-discernable indicia of security information therein. However, surreptitious schemes such as this, while useful for facilitating the detection of the source of unauthorized copying or alteration, do not put a putative forger on notice that the document is possessive of one or more security-enhancing features. This is analogous to protecting a piece of fenced-in property by having a roving guard dog posted, but failing to place a sign on the fence alerting a would-be trespasser to the dog's presence: in both circumstances, while there is ample evidence of both the property being violated and subsequent deployment of the security system after the fact, there is nothing in place to prevent the occurrence of the violation in the first place. Furthermore, while the advent of high-powered computational systems has rendered data glyphs and the algorithms used to generate them timewise and cost effective, the use of relatively insensitive lower resolution printers (such as 180, 200 or 240 dpi, all commonly employed in the banking and check-printing industries) with visually unobtrusive glyphs and related symbols could introduce printing or scanning errors, especially when the glyphs are oriented at angles where they could be confused with printed text or spurious marks.

Accordingly, there exists a need for a font that can be used to print transactional data onto a document such that the printed data includes, or gives the appearance of, additional machine-readable security protection. There exists a further need to present the information contained within the font such that the machine-readable security information can be printed to, and read from, devices of widely-varying resolutions. There also exists a need to provide these capabilities in conjunction with traditional, passive means for human-readable indicia of secure document authenticity.

BRIEF SUMMARY OF THE INVENTION

This need is met by the present invention wherein transactional data culled from an encryptable font is to be printed onto discrete fields disposed on the surface of the document. In the present context, printed indicia encompasses the relatively broad class of fixed and user-defined information applied to the surface of a document, while transactional data is a narrower subset of printed indicia made up of variable and related user-defined data that frequently varies from use to use. The transactional data printed on the document presents both human-intelligible and machine-based optically decodable information, where examples of the former can include characters made up of alphanumeric text, symbols (such as currency designations) and punctuation marks, while examples of the latter can include security characters. Secure documents that combine these human-intelligible and machine-based optically decodable features in one or more of their transaction fields are further amenable to integration with existing security schemes, such as the aforementioned passive background approaches used for document authenticating.

In the present context, "authentication" is the process of independently verifying the genuineness of the item in question, while "self-authentication" implies that everything needed to verify the item can be found with the item. Thus, for example, when encrypted information is stored in a self-authenticating encryptable font, the information, once decrypted, is self-checked for data integrity, then compared to overt (such as human-readable) data stored or situated elsewhere on the document. Also as used in this context, the word "font" defines a particular typeface and size of characters; for fonts designed to be printed on modem printing devices, such as a laser, thermal or ink-jet printers, the representation of the font characteristics is typically stored in a font library or database. This representation can be defined by either bitmapping or equation-based descriptors, the latter of which allow the font to be called and constructed in real (or near-real) time. Bitmapped fonts are less computationally-intensive, while the equation-based fonts have greater flexibility. Regardless of the font representation, when a font is "encryptable", it is amenable to, but not necessarily possessive of, manipulation by an encryption algorithm. In a similar vein, all discussion in this specification relating to "encryption" and "encrypted" generally refers to the employment of a mathematical algorithm to manipulate the character structure of at least a portion of the transactional data in accordance with algorithm protocol such that security of the subject data is enhanced. In this context, then, an encryptable font will nonetheless be in an unencrypted configuration until operated on by an encryption algorithm. Also in the present context, the human-intelligible fonts (such as the aforementioned alphanumeric text, symbols and punctuation marks, all alternately referred to as "human-readable" characters) are juxtaposed with the machine-readable fonts such that the two separate fonts together define a "secure" font.

According to one embodiment of the present invention, a document is disclosed. The document includes a surface configured to receive printed indicia thereon, at least one transaction field defined on the surface, and transactional data disposed on the transaction field. The transactional data is formed from a security font, and includes a patterned background and a plurality of human-readable characters adjacent to and disposed substantially within the background. In the present context, a "security font" includes some measure of security enhancement, and may or may not include encryptable features. As such, it can be a subset of the larger class of fonts referred to as encryptable fonts. Each of the human-readable characters of the security font is defined by a font contour and comprises a character boundary disposed about a substantial entirety of the peripheral shape of the human-readable character and a fill pattern comprising a repeating series of spaced marks, the fill pattern configured to be disposed within the character boundary. In the present context, a font contour defines many of the visible attributes of the font, where many of the contours are named for standards accepted within the printing industry. Examples of font contours include Times New Roman, Helvetica, Courier and the like, just to name a few. The features that make up the human-readable characters preferably form composite characters made up of variations in the character fill, outline and background. These composite characters make it more difficult to conduct unauthorized manipulation of the printed character.

Optionally, the series of spaced marks making up the fill pattern comprise a series of lines, where the lines are substantially parallel to one another. The lines are angularly disposed relative to a longitudinal printing axis of the human-readable characters, where the angle between the lines and a longitudinal printing axis defined by the human-readable characters is substantially diagonal such that they can be forty five or one hundred and thirty five degrees relative to the longitudinal printing axis. Additionally, the thickness of the lines within the fill pattern varies in an oscillatory way such that any given line is thicker or thinner than its immediately adjacent neighbor. In addition, each human-readable character is circumscribed by a boundary. In a preferred embodiment, the boundary is invisible to a human reader, where the only indicia for its existence is the equal horizontal and vertical termination of each spaced line within the character. In this configuration, character outlines can be defined by the ends of the character fill lines. In another option, the font contour is preferably proportionally spaced, and can be defined by, among others, San Serif, San Serif Narrow, or San Serif Narrow Bold. The background pattern preferably comprises a plurality of spaced intercharacter lines. These lines extend laterally from one side of each human-readable character to the other in a venetian blind-like pattern. The intercharacter lines may extend continuously through a string of printed human-readable characters, even when spaces are inserted in between the characters, thus giving each string the appearance of a fine horizontal grid. Preferably, the intercharacter lines are relatively thin (such as one pixel in width) and are sufficient in number to extend beyond font ascenders and descenders, thereby fully encompassing all printed characters along the character vertical dimension. In a further option, the plurality of spaced intercharacter lines are aligned substantially parallel with the longitudinal printing axis defined by the human-readable characters. The vertical dimension of the background pattern is of sufficient height that ascenders and descenders in the human-readable characters are fully contained within the vertical dimension. Furthermore, each line of the plurality of spaced lines of the background pattern forms a continuous line across a substantial majority of the transaction field. In yet another option, each of the human-readable characters is configured to fit within a substantially rectangular-shaped box of width proportional to the character such that the fill pattern is common among each of the human-readable characters in that a common starting point for each character is the upper left comer of the box.

According to another embodiment of the present invention, a secure document with printed transactional data supplied from an encryptable font is provided that includes a surface to receive the printed transactional data, and a plurality of discrete transaction fields disposed on the document's surface. The transactional data is made up of human-readable characters, security characters and a patterned background. The security characters are made up of encryptable data elements (EDEs) in the form of simple geometric shapes arranged as one or more sets of visually perceptible markings that, upon printing, are disposed adjacent the characters of the human-intelligible information such that each individual human-readable character and security characters coupled thereto together define a secure font. Each human-readable character and the EDEs that surround it preferably occupies a substantially rectangular space in the transaction field. The size and configuration of the EDEs are such that they, while robust enough to both convey important security verification data and be readily perceptible to the unaided eye, do not encumber a significant amount of document real estate. It is noted that while the security characters are adjacent each human-readable character, there is nothing that requires data encrypted in the EDEs of the former to be coupled to the latter's immediately adjacent character. Thus, if the EDEs are subject to an encryption algorithm, the machine-readable information they contain could be pertinent to any character within the same string of characters, or correspond to another character in an entirely different transaction field or character string on the face of the document, or even include information not found anywhere else on the document.

Options on the font, such as the composite nature of the human-readable character and the use of spaced intercharacter lines in the pattered background, are similar to those discussed in the previous embodiment. In another option, the EDEs are arranged such that they preferably define one or more horizontally, vertically or diagonally elongate markings, all of which correspond to simple, discrete lines each with multipixel widths. Similarly, the EDEs of the security character can be invariant with, manipulated relative to or independent of each human-readable character type, where there exists numerous character types within each font. By way of example, the human-readable characters include twenty six capital letters, twenty six lowercase letters and ten numerals, among others. Thus, the capital letter "A" refers to a particular type of alphanumeric character, while the capital letter "B" is a different character type. In configurations where the EDEs are capable of manipulation, two additional possibilities exist. First, the font may possess multiple representations of each character type. In such a configuration, each of the human-readable characters (i.e., 26 letters, 10 numerals and other characters) within the library could be represented in numerous ways, where the different ways preferably include similar characters and variable elongate linear markings making up the security characters. This is especially promising in situations where the fonts are defined in bitmap form in a font library, where there can exist numerous variants of each character type within each font. Thus, while all of the human-readable characters of a particular type (the capital letter "A", for example) would look the same, the EDEs above and below would be of differing geometric patterns. These different patterns, in conjunction with a protocol that selects any one of the characters within each character type at random or by algorithm, will, when printed, result in transactional data that gives the appearance of additional security features. This results in a simplistic approach that may confound a would-be forger by placing visually-apparent indicia of an encoding algorithm without requiring the extra activity required of a fully operational encryption system. Second, the EDEs could be configured to be responsive to an encryption algorithm such that actual encryption data may be captured within each of the EDEs placed adjacent the human-readable characters. The use of an encryption system, whether based on an existing symmetric or asymmetric key system, proprietary or non-proprietary versions of either, or part of an entirely new hyperencryption variant, can be seamlessly coupled to the font of the present invention to offer maximum security for sensitive documents. To facilitate the printing of the fine resolution features associated with the font, the document is preferably cooperative with a high-resolution, such as a laser printer, thermal printer or ink-jet printer.

According to another embodiment of the present invention, an encryption-enhanced document is provided. The document includes a top surface, a plurality of transaction fields, and transactional data printed within at least one of the plurality of transaction fields. Many of the salient features of the font are similar to those discussed in the previous embodiments, with the exception that now, the encryptable font is preferably in encryption communication with an encryption algorithm such that, upon operation of the encryption algorithm on the font, at least one of the encryptable data elements is manipulated relative to its unencrypted configuration. "Encryption communication" in the present context means that the encryption information contained within the EDEs can be sensed, interpreted and acted upon by an encryption algorithm. Preferably, the sensing of the security information contained within the EDEs is done by optical means, such as scanning. Furthermore, the EDEs are compatible with and responsive to particular encryption schemes, whether involving symmetric approaches (such as private key-private key), or asymmetric approaches (public key-private key) or other approaches (such as one time pads or related hyperencryption, where a mutually agreed-upon random number stream is presented in a pseudo-ethereal format). Optionally, a flag can be disposed on the document surface to indicate that at least one of the transaction fields contains printed transactional data that may be subject to encryption security features. The flag can occur in one or more of numerous locations, such as an optionally-included magnetic ink character recognition (MICR) field that is commonly used in checks and related negotiable instruments. In addition, a key to trigger the encryption algorithm may be placed either overtly or surreptitiously on the document. The use of such an algorithm, key and encryptable EDEs, in conjunction with a scanner or similar optical device, is capable of providing a real-time indication of the genuineness and accuracy of the transactional data, even if the document was altered with such care that the human-readable characters show no visible signs of tampering. In another option, a latent pantographic image may be disposed on the top surface. The addition of latent images (pantographs, watermarks, graded color schemes or the like) to the encryptable fonts make it more difficult for a forger to achieve a tamper-free appearance, thus enhancing the likelihood of both document and transactional genuineness.

In accordance with another embodiment of the present invention, a secure document printing system includes an electronic font library with a plurality of encryptable fonts, a font manipulating encryption algorithm in signal communication with the plurality of encryptable fonts, and a printer configured to place characters generated by one or more of the fonts in tangible form on the document. In this system, the printer includes a document receiver, a document transport mechanism configured to accept the document from the document receiver and move the document into position to have printed transactional data placed thereon, and a print engine configured to print both human-readable and security characters to the document corresponding to an external print command (such as that coming from a computer). Configurationally, the encryptable fonts, made up of human-readable characters and security characters, are similar to those previously described. The font manipulating encryption algorithm is operably responsive to an encryption command such that, upon receipt of the command (such as input from a keyboard, or a predefined instruction set in a computer program), at least the EDEs of the security characters undergo security enhancement commensurate with the encryption algorithm. Preferably, the printer of the secure document printing system is a laser printer to facilitate the printing of high-resolution text and related markings. The printer may optionally comprise a MICR cartridge such that MICR characters can be added to the document, thus offering additional transaction security by coupling the approaches adopted herein with MICR security enhancement. This additional feature is especially beneficial when the security document is a negotiable instrument, such as a check. The use of MICR in conjunction with the secure font has the added benefit of providing document users with compatibility features to ensure that even if the comprehensive security features made possible by the encryptable fonts of the present invention aren't immediately required to satisfy the user's secure document needs, subsequent upgrades to their systems to acquire such capability can be achieved with a smaller quantum of capital investment.

In accordance with yet another embodiment of the present invention, a method of printing a document is described. The method includes designating a plurality of transaction fields on a surface of the document, introducing the document into a document printing device, receiving a print command into the document printing device, routing the print command to a font library that contains encryptable fonts, printing human-intelligible transactional data in the form of human-readable characters onto one or more of the transaction fields, and printing machine-readable transactional data in the form of encryptable data elements adjacent the human-intelligible transactional data. Preferably, the configuration of the encryptable fonts is similar to those previously described. Optionally, the method may include the additional step of printing a flag on a document to signal to a reading or scanning device that security data may be included in the EDEs or elsewhere. In the present context, a reading device, scanning device or the like is apparatus capable of sensing printed indicia that has been printed onto a medium such that when the medium is placed in optical or related communication with the reading or scanning device, the information contained in the printed indicia can be converted into a form suitable for electronic processing. In another option, further steps can include introducing an encryption algorithm into the document printing device to place the encryption algorithm into signal communication with the security characters, then manipulating the security characters with the encryption algorithm such that at least one of the encryptable data elements is structured by encrypted information.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION

Figure 1:
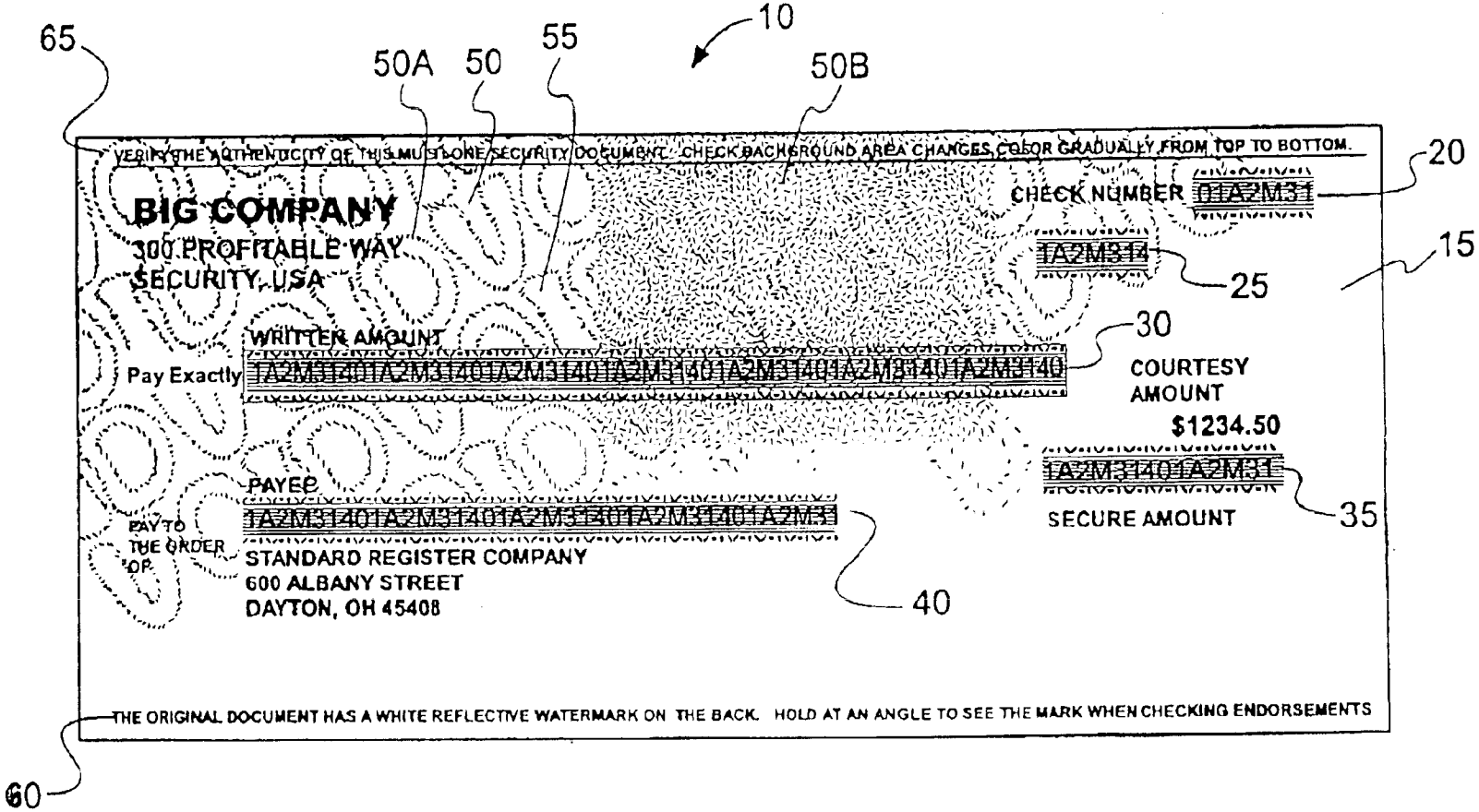
FIG. 1 is an illustration of a negotiable instrument, in the form of a check, showing transactional data formed from an encryptable font printed in various transaction fields disposed on the top surface of the instrument, as well as a partial warning phrase serving as indicia that the negotiable instrument is a reproduction.

Referring initially to FIG. 1, a security document 10, particularly in the form of a negotiable instrument, and more particularly in the form of a check, is illustrated. Security document 10 includes a top surface 15 having a plurality of transaction fields 20, 25, 30, 35 and 40, of which at least the written amount 30, secure amount 35 and payee 40 fields may require additional security. A pantographic image 50 is disposed across substantially the entire top surface 15, and includes an interspersed series of large and small security image elements 50A and 50B, respectively. The size and spacing of various security image elements 50A and 50B are chosen such that the former show up during reproduction by a copier, while the latter are not, resulting in the appearance of a warning phrase (in this case, the word "VOID") 55 made up entirely of large security image elements 50A, on the top surface 15 of a reproduction of security document 10. Additional warnings 60, 65 instruct the holder how to verify other passive forms of document authentication.

Figure 2:
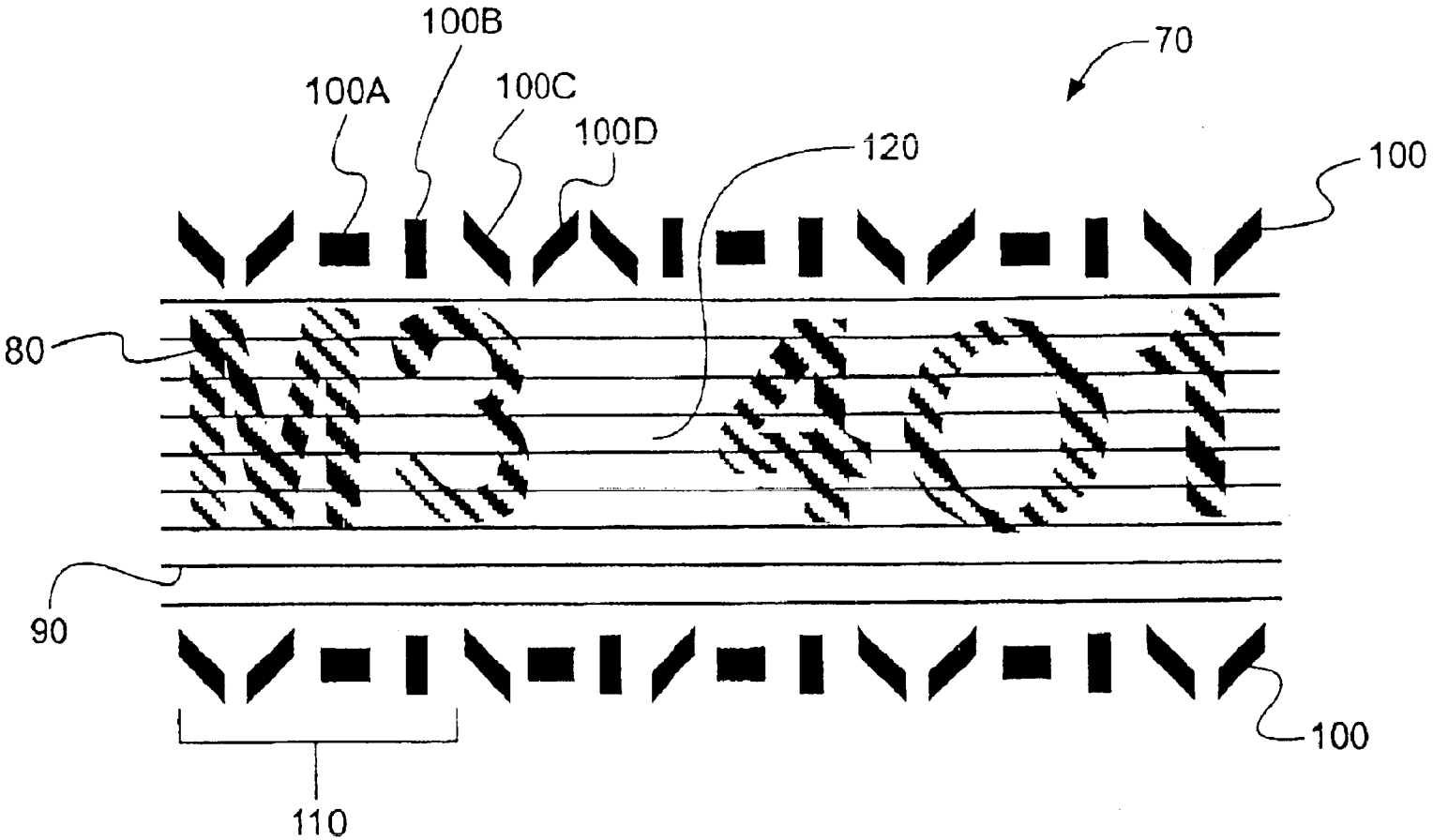
FIG. 2 shows printed human-readable characters, intercharacter lines and security characters that make up a string of transactional data.
Figures 3A, 3B, 3C, 3D:
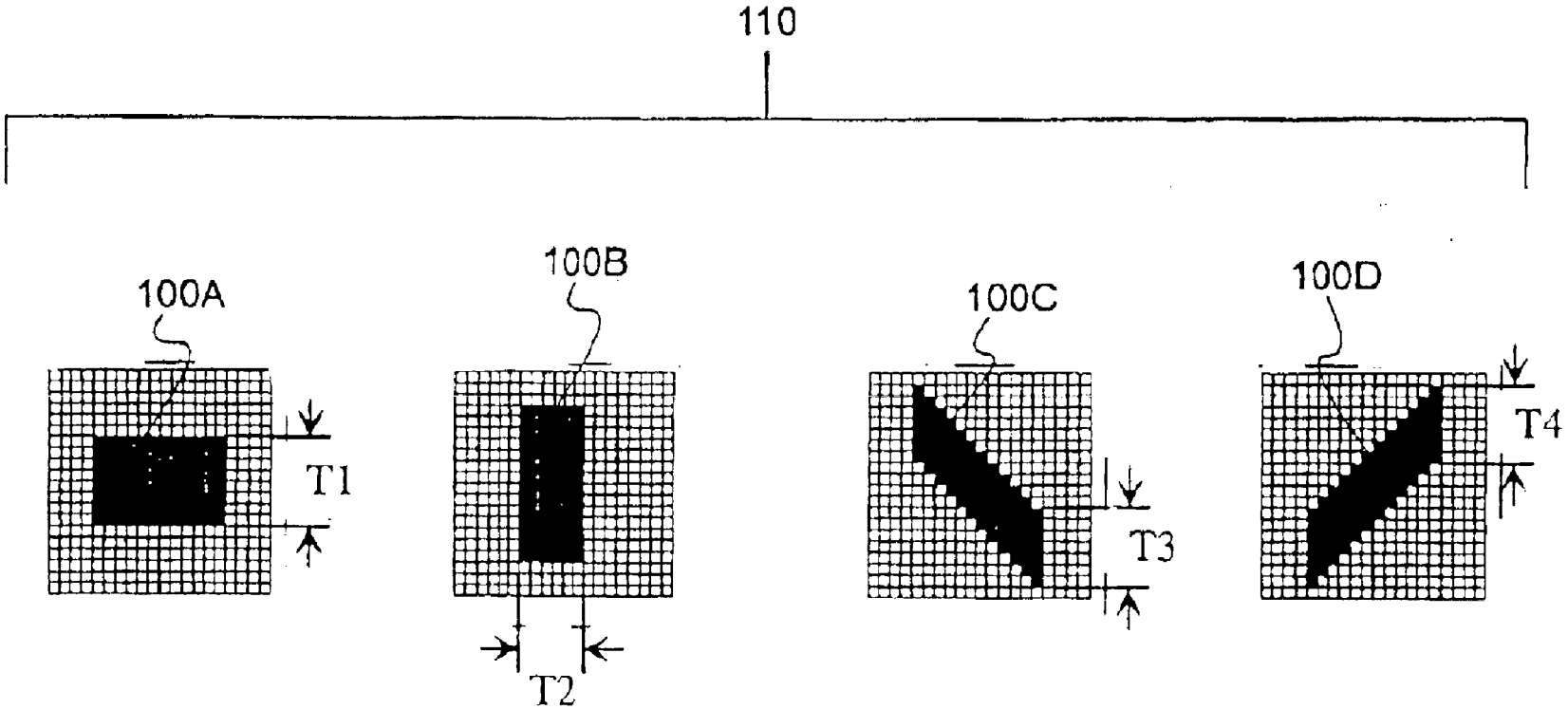
FIGS. 3A through 3D highlight the features of the individual EDEs of the security characters of FIG. 2.

Referring next to FIG. 2, a representative string 70 of printed transactional data using a secure font of the present invention is shown. Printed transactional data is made up of one or more human-readable characters 80, a background of intercharacter lines 90 and a plurality of machine-readable security characters in the form of EDEs 100. The human-readable characters 80, may include alphanumeric text, symbols (such as currency designations) and punctuation marks, all as previously mentioned, as well as closure symbols such as stars or related fillers to occupy otherwise empty fields. Both the human-readable character 80 and the intercharacter line 90 include high-resolution features (discussed in more detail below) that can provide clues as to the whether the text is an original or a reproduction. The intercharacter lines 90 of the background are arranged as a parallel array that extends in continuous fashion across the entire string 70, even when one or more blank spaces 120 are inserted, such that the background substantially aligns with a longitudinal printing axis defined by the lengthwise dimension of the string of characters 80. The intercharacter lines 90 are configured to extend above the characters 80 and below the lowest part of descending characters such that all ascenders and descenders are encompassed fully within the vertical dimension of the grid established by the intercharacter lines 90. The EDEs comprise simple geometric patterns, typically in the form of elongate linear members ranging in length from about ten to twenty pixels, and in width from about five to ten pixels. When placed in groups of four, the EDEs 100 make up a set 110 that includes dashes 100A, hatchets 100B, back slashes 100C and forward slashes 100D, the latter two shown as 135° and 45° diagonal elements. The angles of the back slashes 100C and forward slashes 100D could be configured in any angle, the ones shown being used for convenience. Each set of four represents a single character in the font, although it will be appreciated that the human-readable characters 80 can be represented by fewer than four EDEs. Each symbol is placed in a white square field of 20 dots (pixels) by 20 dots (pixels) on a 600 dots per inch (dpi) scale. All elements are substantially centered in the field from side to side and top to bottom. In addition, the relative width, length and position of the pixel rows in each are such that a reading device will not confound the various edges, regardless of viewing angle. EDE set 110, comprising four element positions, each capable of four EDE orientations (dash, hatch, forward slash and backward slash) is capable of 256 ($4^4$) permutations. Accordingly, an EDE set 110 makes a byte ($2^8$) of information, while the information stored may require a single byte, a fraction of a byte, or multiple bytes. How information is mapped into the EDEs is dependent on the data type, whether the information is to be encrypted, and whether error correction information is added to the original information. This process will be discussed in more detail below in conjunction with FIG. 7.

To confound a would-be forger, the EDEs 100 may be the same for each human-readable character 80 or may vary with character type, as well as vary within a given character type, either randomly, or in response to an encryption algorithm. Furthermore, the EDEs 100 need not correspond to the immediately adjacent human-readable character 80, thereby exacerbating the forger's task of trying to decipher the relationship between the two. For example, the hatchet 100B and back slash 100C disposed adjacent character "3" in the figure might instead be operationally coupled to character "1" at the far right. In addition, the EDEs 100 may contain information entirely independent of that contained in the human-readable characters 80. With these possible permutations, at least three general levels of font security enhancement are available. In the first, the human-readable characters 80 are coupled to a fixed EDE set 110 (or subset thereof), such that each instance of a particular human-readable character 80 will always correspond to an equivalent set 110 of EDEs.

In the second, the human-readable characters 80 are decoupled from any equivalent EDE set 110. This is in effect a randomizing process such that no meaning is attributed to, nor can one be gleaned from, the juxtaposition of an EDE set 110 and an alphanumeric (or other) human-readable character 80. One way this second approach can be implemented in a bitmapped library of fonts is through systematic selection of one of numerous options for each bitmapped font, where each character (for example, the capital letter "M" shown in the figure as the first character of representative string 70) may be represented by any one of numerous bitmapped options, each option maintaining constant the human-readable portion of the font while having a different EDE set representation. In this way, a random selection of a particular character within that character's option set will depict, when printed, the same human-readable character 80 juxtaposed against an EDE set 110 with no logical or otherwise meaningful correlation to the human-readable character 80. A variation of the second approach of decoupling the EDE sets 110 from the human-readable characters 80 is to have the EDE sets 110 contain meaningful information in and of itself, such that while independent of the human-readable characters 80, can contain additional security information.

In the third, EDE sets 110 that have been encrypted in accordance with an encryption algorithm are coupled to the human-readable characters 80 in ways that would make it exceedingly difficult to discern the relationship between the two. When the EDE sets 110 are encrypted, the would-be attacker would not know how to change the EDE sets 110 such that the EDEs would reflect any changes made to the rest of the document. For example, if the amount field 30 were changed on the document and information about the amount were stored in the encrypted EDEs, the would-be attacker would not know how to change the EDEs to reflect the corresponding change in the amount, thus evidencing a discrepancy between the decrypted EDEs and the altered quantity in the amount field 30 on the check. However, it will be appreciated that the actual amount shown in the amount field 30 need not be stored in the EDE set 110, as they can hold other information, including a simple signature. In this embodiment, the signature could be similar to a checksum of the overt information found on the document. If everything stored in the EDE set 110 is added-up using a unique algorithm, then after decrypting the EDEs, that information can be run through the same unique algorithm to produce a checksum that can be compared to the checksum stored in the EDEs. It will be appreciated that while checksums sometime imply a simple additive algorithm, a signature can be created using a simple or complex algorithm. When a signature is used instead of the amount shown in the amount field 30, it may not be possible to tell what item on the document has been altered by the would-be attacker, but the information on the document would be questionable and, therefore, not authentic.

In the secure font of the present invention, the self-authenticating features are found in the EDEs. In one embodiment of the secure document (i.e., a check), self-authentication information can be notoriously placed on the surface of the document, in, for example, one or more of the print fields (payee, written amount, date or the like), the MICR line, and document serial number location. Such information could be stored in the EDEs in either an unencrypted or encrypted form, while other information not required for authentication may also can be stored in the EDEs. To authenticate in the context of an encrypted EDE means that the EDEs must be decrypted then compared. The encryption provides a very high level of confidence that information has or has not been altered; if the EDE sets 110 are altered, the decryption will fail, thus providing indicia of failed authentication at one level. Another level of authentication takes place when the information stored in the EDE sets 110 are compared to the information on the document. When the overt information stored on the document matches the information or signature found in the EDE sets 110, such agreement is indicative of authenticated information. To self-authenticate, additional information on the document provides indicia as to how to either decrypt the EDEs or where to look for the instructions on how to decrypt the EDEs. In the latter case, an encryption key can be stored on the document, or could be a reference to a dictionary, encyclopedia or similar database that contains needed information to decrypt the document. The reference could be as simple as banking information found in the MICR line.

Referring now to FIGS. 3A through 3D, specific features of the dash 100A, hatchet 100B, back slash 100C and forward slash 100D that make up the individual EDEs 100 are shown. The most notable difference between the geometric patterns defined by the present invention and those of the prior art relates to their physical dimensions, particularly their width, or thickness, as well as the spacing between each EDE 100. For example, dash 100A is a composite comprising 12 horizontal pixels and 8 vertical pixels, that latter of which is equated to thickness T1. Similarly, hatchet 100B is 6 horizontal pixels (corresponding to thickness T2) and 14 vertical pixels, while back slash 100C has a diagonally-oriented construction of 12 horizontal pixels and 18 vertical pixels to create a line thickness T3 of 7 pixels, and forward slash 100D is also 12 horizontal pixels by 18 vertical pixels, with a thickness T4 of 7 pixels. While particular pixel dimensions have been presented in conjunction with the EDEs in the figure, it will be appreciated by those skilled in the art that other dimensions may be utilized; for example, the width, length and spacing of the EDEs 100 may be made up of a greater or fewer number of pixels according to the need. As previously mentioned, the center of each EDE 100 is substantially centered in a 20 by 20 pixel grid such that minimum spacings between adjacent EDEs 100 are guaranteed. This feature can be helpful in avoiding adjacent EDE aliasing and a concomitant confounding of the data contained therein.

Figure 4:
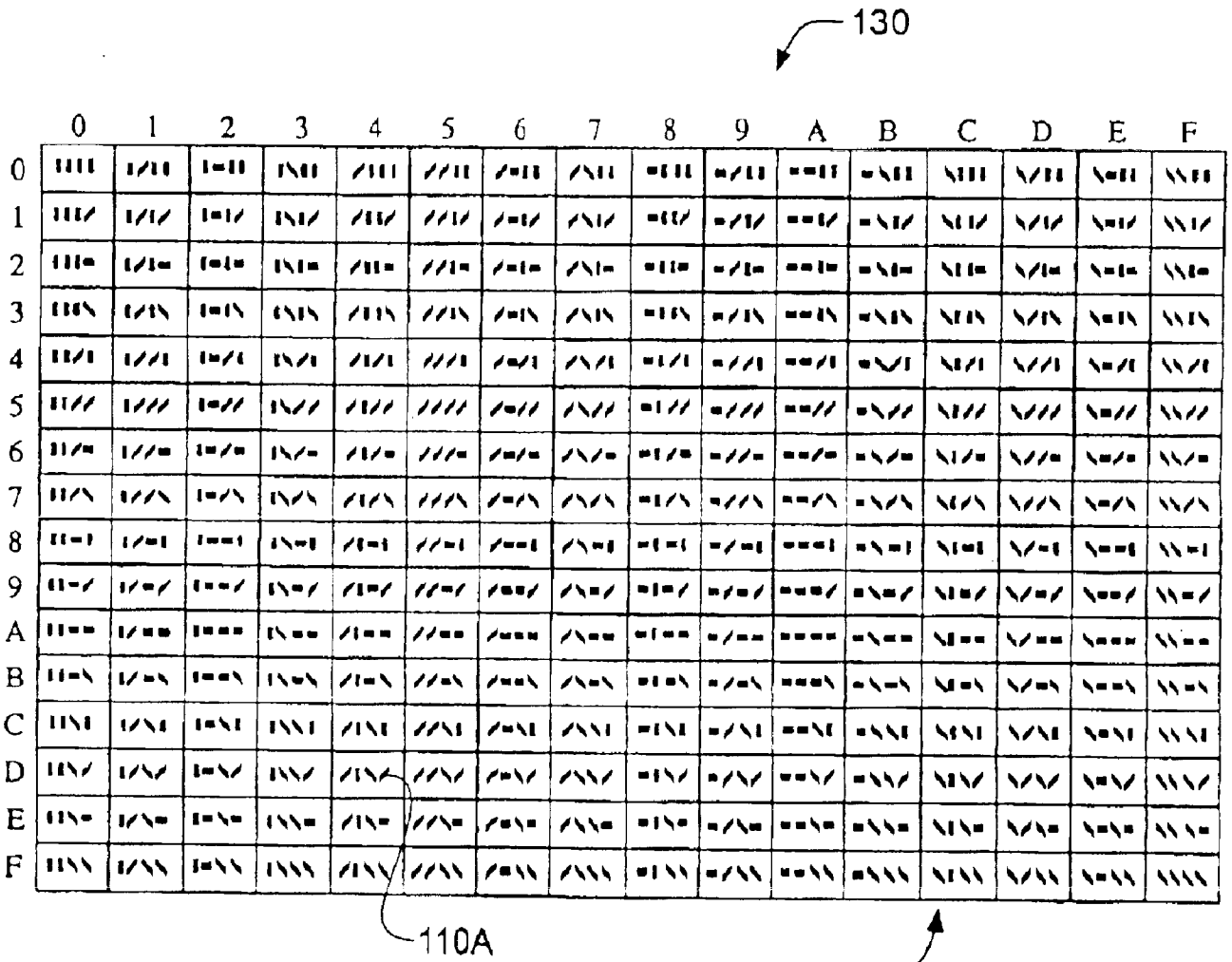
FIG. 4 shows a table with all of the possible encryption combinations of a set of four EDEs.

Referring next to FIG. 4, each of the four EDE positions can assume one of the four orientations, thus capable of representing up to 256 permutations of data, which is equivalent to one byte of binary information. For example, the set of four EDEs 110A at row "D", column "4" could correspond to the capital letter "M", while control characters (such as carriage return or the like) could be reserved for the first two columns within character/symbol map 130. Security features (such as those implemented with an encryption algorithm) could alter the mapped correlation, so that even if an unauthorized user gained access to the character/symbol map 130, such knowledge would be useless absent insight as to how they could have been altered by the encryption. As mentioned previously, additional encryption routines could further alter the relation between an EDE set 110 and the human-readable characters 80 such that an individual human-readable character need not correspond to a particular EDE set 110 placed in immediate proximity to it. This approach could be triggered either from a key within one or more of the 256 permutations making up the font, or from a separate key located elsewhere on the surface of the document 10 of FIG. 1. Similarly, a flag (not shown) could be placed on the surface of the document 10 of FIG. 1 to indicate to a reading or scanning device (not presently shown) that one or more of the EDE sets 110 could contain additional security information.

Figure 5B:
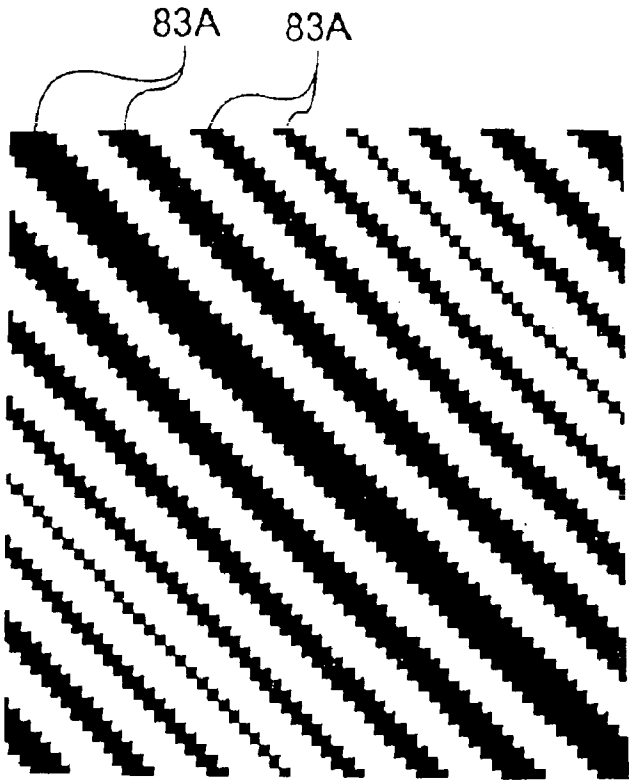
FIG. 5B is a view of a portion of the character of FIG. 5A, highlighting the oscillating thickness of a series of lines that defines a fill pattern that can be used by the human-readable characters.
Figure 5A:
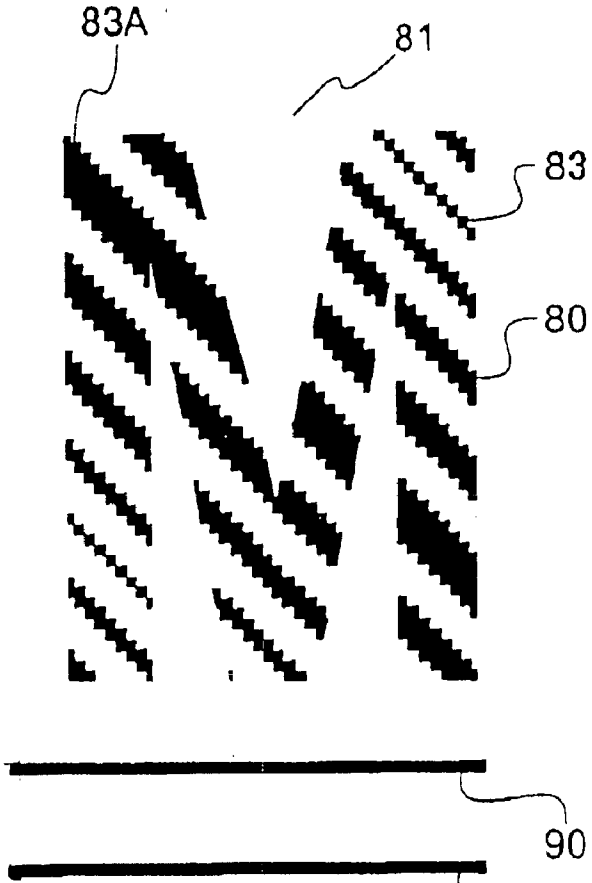
FIG. 5A is an illustration of a single character taken from the string of transactional data of FIG. 2, with the security characters and some of the intercharacter lines removed for clarity.

Referring next to FIGS. 5A and 5B in conjunction with FIG. 1, details of a printed human-readable character 80 according to an embodiment of the present invention are shown, with EDE set 110 and a majority of the intercharacter lines 90 removed for clarity. By way of example, when the document upon which secure data is printed is a negotiable instrument, such as the check 10, a 10 or 12 point font could be used for the human-readable characters 80 that are printed in the written amount 30, payee 40, check number 20 and the date 25 fields, while a larger font, such as a 21 or 24 point, could be used for the secure amount 35. In one embodiment, the font can be a Narrow Bold San Serif for the fundamental proportionally spaced font contours of human-readable character 80. Using bold font attributes allows flexibility in the graphical elements for the character fill (discussed below), while a narrow font attribute permits a large number of characters in a given line. Similarly, the San Serif font minimizes the amount of fine detail in any given character contour. Likewise, proportionally spaced fonts help to place more characters in a line of type, as well as makes simple cut-and-paste alteration more difficult. The fonts are stored in library or database made up of individual characters in electronic, preferably bitmap form, including all twenty six letters (both lowercase and capitals), Arabic numerals 0–9, as well as punctuation marks, currency symbols and related marks. Within the human-readable character 80 is a fill pattern 83 to define the character's shape. Fill pattern 83 is made up of generally diagonal lines 83A that vary in thickness in an oscillating fashion, as shown particularly in FIG. 5B. In the oscillating pattern shown, the thickest line may be five pixels wide, with each subsequent adjacent line incrementally decreasing in thickness until they are one pixel wide, after which they increase in thickness until again reaching the full width. It will be appreciated by those skilled in the art that the widest line depicted is five pixels, other thickness may also be chosen, such as a six pixel maximum. By having its shape defined solely by fill pattern 83, human-readable character 80 requires no outline of the character boundary 81, thus providing a more subtle indication of document reproduction. In a preferred embodiment, fill pattern 83 of human-readable character 80, specifically that of the capital letter "M", is created by a repeated, generally equidistant spacing of diagonal lines 83A within the space defined by boundary 81. In the example shown, the characters are defined by 135° diagonal lines. The line weight in the fill set varies in a periodically increasing and decreasing manner, with a minimum thickness of a single pixel to a maximum of five pixels. It will be appreciated by those skilled in the art that other combinations are possible, including the common solid fill and a variety of screen fills. The character shown includes a common fill pattern for all characters with a common starting point in the upper left corner for all characters. Other line angles, combinations of line weights, patterns of line variation, and type of fill elements are also possible. Character outlines can be made visible by the ends of the fill elements (lines). While the figure depicts an invisible character boundary 81 to determine the ends of the lines, the outline could be made overtly visible by single or multiple pixel width lines. As previously mentioned, a character background of one-pixel wide horizontal intercharacter lines 90 are uniformly spaced to include ascenders and descenders. These lines are designed to fill the entire background area of each character and join seamlessly with preceding and succeeding characters. As with other features of the present font, other patterns are possible. The details of character outline, fill, and background are built into a single bitmap for each character to insure speedy and accurate rendition of these complex font characters on the issuing printer for the original document. Preferably, print background (shown in FIG. 1) surrounds each human-readable character 80 such that a finite space for height and width are reserved when each human-readable character 80 is printed. Preferably, this print background is defined by a simple geometric shape, such as a square or rectangle, and may be of either constant or proportional spacing.

In operation, the controlling software of the application makes a font selection, in effect instructing the printer which font to use, and then sends the human-readable character 80 to the printer following the standard mapping. In the case of printing EDEs, the data (numbers, text, dates or the like) corresponding to the EDEs is converted from its native form to more storage-efficient form. This results in a set of bytes that is randomized by encryption(if necessary) and made resistant to data loss through the addition of error correction code, and is then sent to the printer just after the font representing the EDEs is selected. Preferably, the fonts and print devices used to print the human-readable character 80, intercharacter lines 90 and security characters 100 would possess sufficient resolution to ensure the character and line clarity necessary to convey all of the aforementioned human- and machine-readable security attributes. Accordingly, the fonts of the present invention are envisioned to be used with laser printers, where print resolutions of 600, 1200 dpi (and greater) are commonplace.

Figure 6:
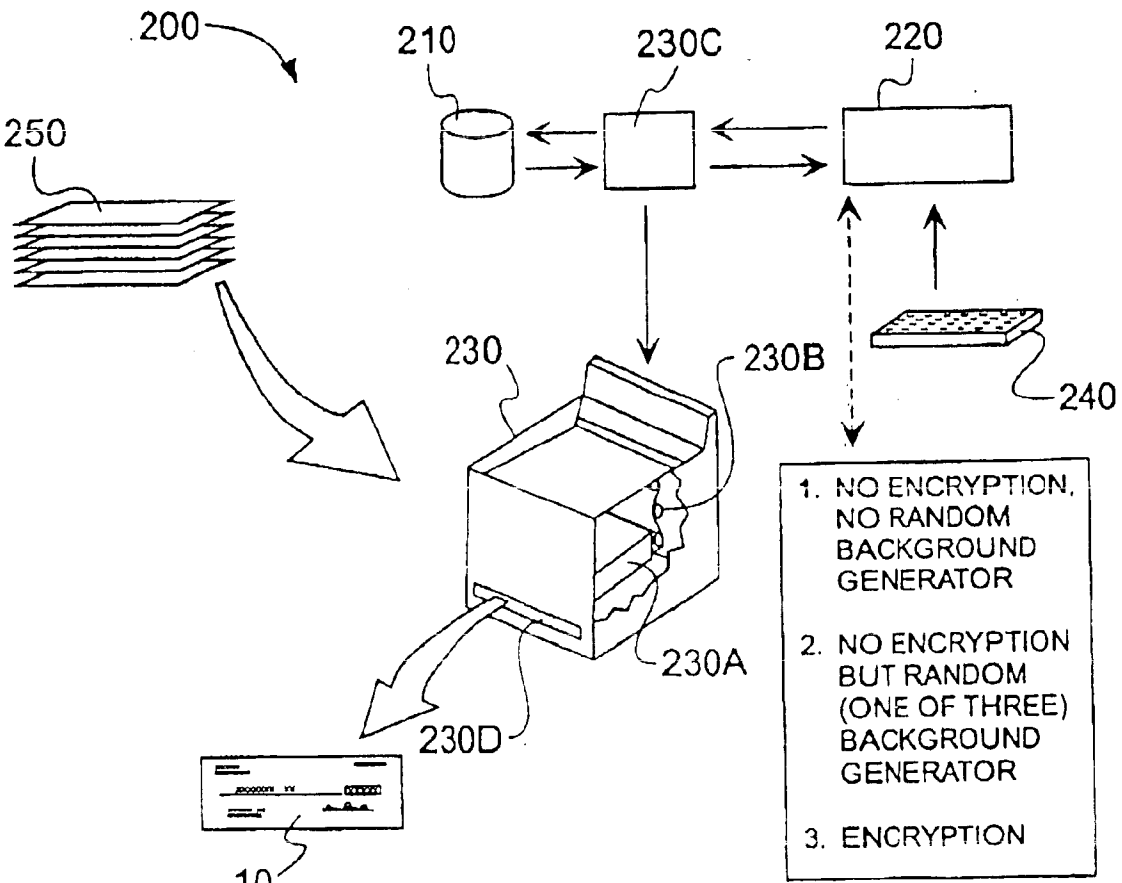
FIG. 6 shows a block diagram of a printing system incorporating the encryptable fonts of the present invention.

Referring now to FIG. 6, a block diagram 200 depicting the interconnection of the major parts of a secure document printing system is shown. Font database 210 holds, in electronic form, descriptions of fonts to be printed on document 10. Upon input from a text file (not shown) or an input device, such as keyboard 240, the desired fonts are retrieved from the font database 210, and then sends the fonts and instructions to printer 230. In most applications where special fonts are to be used, the font database 210 is configured as a series of PROMs (programmable read-only memory chips) onto which the font description is burned, or are downloaded into a secure location of the printer's volatile or non-volatile memory. Once the fonts are in the printer, they are simply referenced by the software of the controlling application. In an alternative configuration, the font descriptions can be equation-based (rather than bitmapped), in which case the desired font could be called by printer driver 230C. Internal print mechanisms, including document receiver 230A, document transport mechanism 230B and print head 230D cooperate to apply the text to paper 250. If encryption is selected, encryption algorithm 220, which may be resident within the printer 230, or remotely located (such as within the computer generating the text, not shown), is applied to the font database 210 to provide manipulation of the EDEs. The relative strength of the encryption is determined by numerous factors, including the preprocessing of the data before it is encrypted, the encryption algorithm used, and the size of the key. In the preferred embodiment, all of these factors would be used to control the resulting strength of the encryption, the attributes of which are transparent to the user. This approach involves both the greatest level of protection, as well as the most significant amount of implementation strategy and integration. A somewhat less extensive approach can be accomplished with the previously-mentioned random EDE generator (not shown), which is also present to provide indicia of an encryption algorithm without the necessity of any actual encryption hardware or software. Such operation is performed by randomizing the EDE sets of 110 (shown in FIGS. 2, 3A–3D and 5) such that no clear correlation between a particular human-readable character and its adjacently-disposed security characters 100. For example, the letter "M", shown in FIGS. 2 and 5A, could have three or four (or more, depending on storage space) separate representation options within each font such that while the human-readable character 80 is constant, the surrounding EDE set 110 would be varied. A putative forger, upon noticing an apparent variation among similar letters, might be disinclined to pursue alteration under the suspicion that what is in reality purely random variations are encryption-protected. Also as previously discussed, a fixed relationship between the human-readable character 80 and the EDE set 110 provides a more modest, but useful, level of enhanced document protection.

Lines of MICR data can also be added to establish continuity with existing check printing systems. MICR data can provide an additional security enhancement, in the form of authentication redundancy. Where the secure document 10 is in the form of a check, the presence of MICR provides valuable security information, including the document serial number, bank routing number, check digit used to help validate the bank routing number, and sometimes the dollar amount. This and other data can also then be encoded in the EDE sets 110, giving an additional layer of validation of the data contained in the EDE sets 110 if that information was encoded in the EDE sets 110. While it is likely that the kind of information found in the MICR data would be encoded with EDEs, but it is not required that the EDEs contain MICR data.

Figure 7:
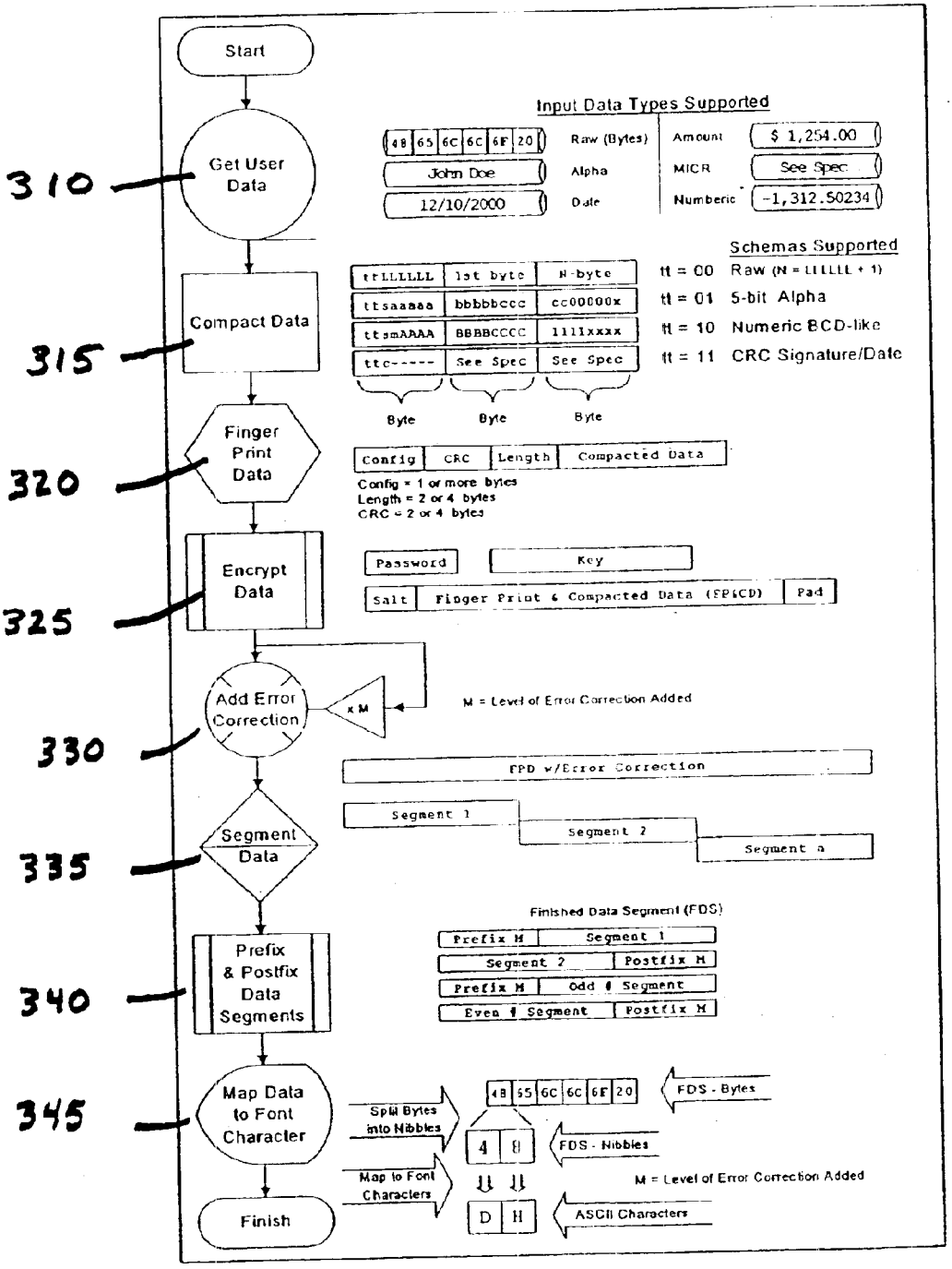
FIG. 7 shows a flow chart outlining the process used to convert data into EDEs and print them onto a document.

Referring next to FIG. 7, a secure font implementation flow chart 300 is shown. The process is used in situations where the encoding of data into the EDE set 110, rather than simply mapping incoming data to the EDEs, is performed. In this process, user data 310, which corresponds to transactional data to be printed on a document, is identified, and then entered. Processing steps include data compaction 315, fingerprinting 320, encrypting 325, adding error correction 330, segmenting 335, prefixing and postfixing 340 and finally mapping it to a font character 345 for printing. In compaction step 315, due to the limited amount of space allotted on many documents, such as checks and related negotiable instruments, the amount of the various types of user data needs to be reduced. This data, which can include raw, alpha, date, MICR and numeric varieties, is compacted using one of four major schemas: Raw Schema; Alpha Schema; Numeric Schema and CRC Signature/Date Schema. In the fingerprint step 320, a twofold objective is realized. First, the fingerprint will help detect unauthorized changes in the data, and second, the fingerprint will also reveal to the reading device how the data is structured. Two formats for data fingerprinting are used: long and short. The encryption step 325 is optional in the process, as was described in the preceding paragraph in conjunction with FIG. 6. If it is not used, it is possible for an unauthorized user who ignores the warning signs to modify the printed data stream without detection. Error correction 330, like the encryption 325 step before it, is optional. In a simplified implementation of the process depicted in the figures, it will be appreciated by those skilled in the art that, in addition to the encryption and error correction steps, compaction, finger printing, encryption, error correction, prefixing and postfixing can be optional. The error correction 330 stage is most important in image scanning and related processing, especially when line imagers are being used. The next step, segmenting the data 335, will determine the number of output lines required to print the processed information. The next step, prefixing and postfixing data 340, indicates if any error correction or encryption was employed in the font. In the last step, mapping 345, secure font addressable characters are written to the document.

Having described the invention in detail and by reference to preferred embodiments thereof, it will be apparent that modifications and variations are possible without departing from the scope of the invention defined in the appended claims.

What is claimed is:

1. A document comprising:

a surface configured to receive printed indicia thereon;

at least one transaction field defined on said surface; and transactional data disposed on said transaction field, said transactional data formed from a security font, said transactional data comprising:

a background comprising a pattern; and a plurality of human-readable characters adjacent to and disposed substantially within said background, each of said human-readable characters defined by a font contour and comprising:

a character boundary disposed about a substantial entirety of the peripheral shape of said human-readable character; and a fill pattern comprising a repeating series of spaced lines that are angularly disposed relative to a longitudinal printing axis of said human-readable characters, said fill pattern configured to be disposed within said character boundary.

2. A document according to claim 1, wherein said lines are substantially parallel to one another.

3. A document according to claim 2, wherein the angle said substantially parallel lines are angularly disposed relative to a longitudinal printing axis of said human-readable characters is substantially forty five degrees.

4. A document according to claim 2, wherein the angle said substantially parallel lines are angularly disposed relative to a longitudinal printing axis of said human-readable characters is substantially one hundred and thirty five degrees.

5. A document according to claim 1, wherein said character boundary is invisible such that a visible outline of said character is formed by the ends of said lines rather than by said character boundary.

6. A document according to claim 1, wherein said contour of said human-readable character is proportionally spaced.

7. A document according to claim 6, wherein said font contour is San Serif.

8. A document according to claim 6, wherein said font contour is San Serif Narrow.

9. A document according to claim 6, wherein said font contour is San Serif Narrow Bold.

10. A document according to claim 1, wherein said background pattern comprises a plurality of spaced intercharacter lines.

11. A document according to claim 10, wherein said plurality of spaced intercharacter lines are aligned substantially parallel with a longitudinal printing axis defined by said human-readable characters.

12. A document according to claim 11, wherein said plurality of spaced intercharacter lines are no more than one pixel wide.

13. A document according to claim 10, wherein each said line of said plurality of spaced lines of said background pattern forms a continuous line across a substantial majority of said transaction field.

14. A document according to claim 1, wherein a vertical dimension of said background pattern is of sufficient height that ascenders and descenders in said human-readable characters are fully contained within said vertical dimension.

15. A document according to claim 1, wherein each of said human-readable characters is configured to fit within a substantially rectangular-shaped box of width proportional to said character such that said fill pattern is common among each of said human-readable characters in that a common starting point for each character is the upper left comer of said box.

16. A document comprising:

a surface configured to receive printed indicia thereon;

at least one transaction field defined on said surface; and transactional data disposed on said transaction field, said transactional data formed from a security font, said transactional data comprising:

a background comprising a pattern; and a plurality of human-readable characters adjacent to and disposed substantially within said background, each of said human-readable characters defined by a font contour and comprising:

a character boundary disposed about a substantial entirety of the peripheral shape of said human-readable character; and a fill pattern comprising a repeating series of substantially parallel lines the thickness of which varies in an oscillatory way such that any given line is thicker or thinner than its immediately adjacent neighbor, said fill pattern configured to be disposed within said character boundary.

17. A secure document comprising:

a surface configured to receive printed indicia thereon;

a plurality of discrete transaction fields defined on said surface; and transactional data disposed on said transaction field, said transactional data formed from an encryptable font, said transactional data comprising:

a background comprising a pattern;

a plurality of human-readable characters adjacent to and disposed substantially within said background, each of said human-readable characters defined by a font contour and comprising:

a character boundary disposed about a substantial entirety of the peripheral shape of said human-readable character; and a fill pattern comprising a repeating series of spaced marks, said fill pattern configured to be disposed within said character boundary; and a plurality of security characters adjacent to and at least partially surrounding said human-readable characters, wherein said plurality of security characters define at least one encryptable data element to provide indicia of potential security features incorporated into said secure document.

18. A secure document according to claim 17, wherein said background pattern comprises a plurality of spaced intercharacter lines extending across the entire lateral dimension of each of said plurality of human-readable characters.

19. A secure document according to claim 18, wherein said plurality of spaced intercharacter lines are substantially parallel to one another.

20. A secure document according to claim 19, wherein at least one of said plurality of intercharacter lines intersects at least a portion of said fill pattern.

21. A secure document according to claim 17, wherein said at least one encryptable data element is arranged in the form of a linear marking.

22. A secure document according to claim 21, wherein said linear marking is selected from the group consisting of horizontally elongate markings, vertically elongate markings and diagonally elongate markings.

23. A secure document according to claim 21, wherein said at least one encryptable data element is invariant relative to a particular character type.

24. A secure document according to claim 21, wherein said at least one encryptable data element is configured to vary relative to a particular human-readable character type to provide indicia of a potential encoding algorithm operative upon said transactional data.

25. A secure document according to claim 21, wherein said encryptable font is configured to vary in response to an encryption algorithm such that said encryptable data elements contain encryption information.

26. A secure document according to claim 21, wherein said encryptable data elements are independent of said human-readable characters.

27. A secure document according to claim 17, wherein said series of spaced marks comprise a series of spaced lines.

28. A secure document according to claim 17, wherein each of said series of spaced lines are evenly spaced and have a line thickness different from that of the next line in said repeating series such that said line thickness varies across the entirety of said fill pattern in an oscillating way.

29. A secure document according to claim 28, wherein said series of spaced lines are angularly oriented relative to a longitudinal printing axis of said plurality of human-readable characters.

30. A secure document according to claim 29, wherein said series of spaced lines are diagonally oriented relative to said longitudinal printing axis of said plurality of human-readable characters.

31. A secure document according to claim 17, wherein said encryptable font is configured to be printed with a laser printer.

32. A secure document according to claim 17, wherein said encryptable font is configured to be printed with an ink-jet printer.

33. An encryption-enhanced document comprising:

a surface configured to receive printed indicia thereon;

a plurality of discrete transaction fields disposed on said surface; and transactional data formed from an encryptable font, said transactional data printed within at least one of said plurality of transaction fields, said transactional data comprising:

a plurality of human-readable characters defined by a fill pattern disposed therein, said fill pattern in turn defined by a repeating series of spaced lines;

a plurality intercharacter lines arranged in a spaced, parallel pattern, each of said plurality of intercharacter lines extending across the entire lateral dimension of each of said plurality of hum an-readable characters, at least one of said plurality of intercharacter lines intersecting at least a portion of said fill pattern of at least one of said plurality of human-readable characters; and a plurality of security characters adjacent to and at least partially surrounding said human-readable characters, wherein said plurality of security characters includes at least one encryptable data element to provide indicia of potential security features incorporated into said security document.

34. An encryption-enhanced document according to claim 33, further comprising a flag disposed on said document to selectively provide an indication that at least one of said plurality of transaction fields contains printed transactional data that may be subject to encryption security features.

35. An encryption-enhanced document according to claim 33, wherein said encryptable font is in encryptable communication with said encryption algorithm such that, upon operation of said encryption algorithm on said encryptable font, said at least one encryptable data element are manipulated relative to their unencrypted configuration.

36. An encryption-enhanced document according to claim 33, further comprising a latent image disposed on said top surface.

37. An encryption-enhanced document according to claim 36, wherein said latent image disposed on said top surface is a pantograph.

38. A method of printing a document, said method comprising the steps of:

designating a plurality of transaction fields on a surface of a document;

introducing said document into a document printing device;

receiving a print command into said document printing device;

routing said print command to a font library to retrieve encryptable fonts for printing, wherein each of said plurality of encryptable fonts is configured to produce printed transactional data onto said document, said plurality of encryptable fonts including electronic descriptions comprising:

a background comprising a pattern;

a plurality of human-readable characters configured to be printed, each of said plurality of human-readable characters comprising:

a fill pattern disposed therein; and a character boundary disposed about a substantial entirety of the peripheral shape of said human-readable character; and a plurality of security characters configured to be printed adjacent to and at least partially surrounding said plurality of human-readable characters, wherein said plurality of security characters include at least one encryptable data element that can be used to provide machine-readable indicia of security features incorporated into said encryptable font;

printing human-intelligible transactional data corresponding to said plurality of human-readable characters in at least one of said plurality of transaction fields; and printing machine-readable transactional data corresponding to said at least one encryptable data element, said printing machine-readable transactional data disposed adjacent said human-intelligible transactional data.

39. A method of printing a secure document according to claim 38, comprising the additional step of incorporating a flag on a surface of said document to enable a reading device to recognize that at least a portion of said machine-readable transaction data is subject to additional security features.

40. A method of printing a secure document according to claim 38, wherein said fill pattern is defined by a repeating series of spaced lines.

41. A method of printing a secure document according to claim 38, further comprising configuring said pattern in said background to comprise a plurality of intercharacter lines configured to be printed such that they extend across the entire lateral dimension of each of said plurality of human-readable characters disposed in said at least one of said plurality of transaction fields.

42. A method according to claim 38, further comprising the steps of:

introducing an encryption algorithm into said document printing device to place said encryption algorithm into signal communication with said plurality of security characters; and manipulating said plurality of security characters with said encryption algorithm such that said at least one encryptable data element is structured by encrypted information.

* * * * *

UNITED STATES PATENT AND TRADEMARK OFFICE

CERTIFICATE OF CORRECTION

PATENT NO. : 6,886,863 B1
DATED : December 19, 2002
INVENTOR(S) : Morwy, Jr. et al.

It is certified that error appears in the above-identified patent and that said Letters Patent is hereby corrected as shown below:

Column 3,
Line 25, “modem” should read -- modern --.

Column 4,
Line 57, “comer” should read -- corner --.

Column 17,
Line 40, “hum an-readable” should read -- human-readable --.

Signed and Sealed this

Third Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,886,863 B1
DATED : May 3, 2005
INVENTOR(S) : Morwy, Jr. et al.

It is certified that error appears in the above-identified patent and that said Letters Patent is hereby corrected as shown below:

Column 3,
Line 25, “modem” should read -- modern --.

Column 4,
Line 57, “comer” should read -- corner --.

Column 17,
Line 40, “hum an-readable” should read -- human-readable --.

This certificate supersedes Certificate of Correction issued January 3, 2006.

Signed and Sealed this

Fourteenth Day of February, 2006

JON W. DUDAS
*Director of the United States Patent and Trademark Office*